United States Patent [19]

Moore et al.

[11] Patent Number: 4,515,423

[45] Date of Patent: May 7, 1985

[54] EXTENSION DEVICE FOR ELECTRICALLY POWERED TOOLS

[76] Inventors: Jerry R. Moore, 12111 Cullman, Whittier, Calif. 90604; C. Peter Van Dusseldorp, 560 E. Second St., La Habra, Calif. 90631

[21] Appl. No.: 481,898

[22] Filed: Apr. 4, 1983

[51] Int. Cl.[3] ..... H01R 11/00

[52] U.S. Cl. ..... 339/28; 339/58; 339/2 A; 30/122

[58] Field of Search ..... 339/15, 16, 58, 119 R, 339/124; 30/296 R, 122, 276

[56] References Cited

U.S. PATENT DOCUMENTS

| | | | |
|---|---|---|---|
| 3,720,902 | 3/1973 | Becker et al. | 339/119 R |
| 3,928,715 | 12/1975 | Holden | 339/15 |
| 4,121,880 | 10/1978 | Rollins et al. | 339/119 R |
| 4,136,446 | 1/1979 | Tripp | 30/276 |
| 4,226,021 | 10/1980 | Hoff | 30/276 |
| 4,285,128 | 8/1981 | Schnell et al. | 30/276 |
| 4,359,822 | 11/1982 | Kolodziejczyk | 30/122 |
| 4,394,057 | 7/1983 | Williams et al. | 339/15 |

*Primary Examiner*—Gil Weidenfeld
*Assistant Examiner*—David L. Pirlot
*Attorney, Agent, or Firm*—Edgar W. Averill, Jr.

[57] ABSTRACT

An extension device for use with electrically powered tools such as hedge trimmers to permit their use at an extended distance from the operator. The device has a hollow extension pole and an electrical cord which powers the tool and which is held almost completely within the extension pole. A female plug is affixed to the tool end of the extension pole and the male end of the cord extends from the hand held end of the extension pole. A strap grasps the hand held portion of the tool to be extended.

13 Claims, 11 Drawing Figures

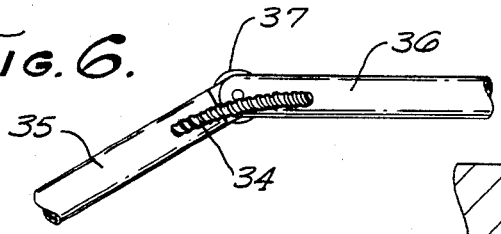
FIG. 6.
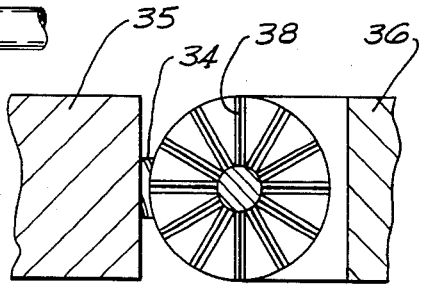
FIG. 8.
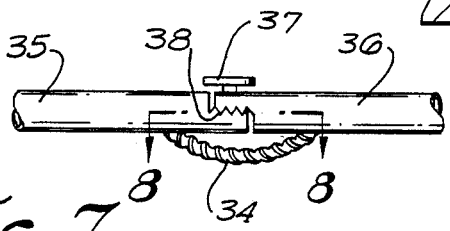
FIG. 7.
FIG. 9.
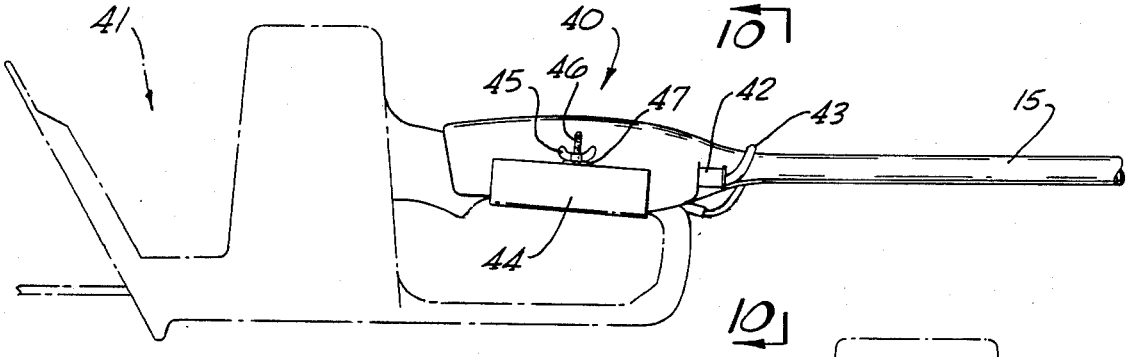
FIG. 11
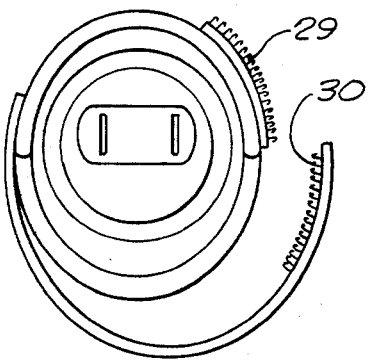
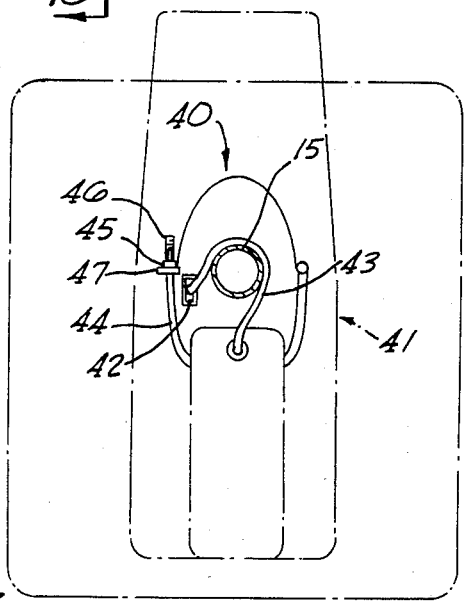
FIG. 10.

EXTENSION DEVICE FOR ELECTRICALLY POWERED TOOLS

BACKGROUND OF THE DISCLOSURE

The field of the invention is hand tools and the invention relates more specifically to devices for permitting the use of such hand tools at an extended distance from the user.

Many hand tools such as electrical hedge trimmers are generally designed to be held directly by the user and used in the immediate proximity of the operator. If the operator wishes to trim a hedge which is above the height of the user's head, the typical procedure is to use a step ladder or other height extending device such as a cherry picker. The use of a step ladder adjacent to a hedge creates a safety hazard and devices such as cherry pickers are not available at reasonable cost for the average homeowner or professional gardener. With the increased use of shaped trees in landscaping, the need for trimming at a distance beyond the reach of the user has become more widespread.

The use of a step ladder, particularly when combined with a necessity to reach away from the step ladder while holding the trimmer, creates a substantial safety hazard. The ground under a hedge or tree is typically not level and in the case of a hedge there is nothing sturdy against which a ladder may be leaned.

In the past, various extension poles have been proposed which typically would be screwed on to the handle of the tool after which the tool would be plugged in and operated at a remote distance. Such tools, however, have not found widespread use for several reasons. A common drawback of such devices when used with electrically powered tools is that the electrical cord hangs down from the tool and becomes readily ensnarled in the branches. In the case of a hedge trimmer specifically, it is surprisingly easy for the cord to become tangled in the branches which are being trimmed and to actually trim through the electrical cord itself. Furthermore, most prior art devices have no ready means of turning the tool on and off which for most trimming operations is a highly desirable feature.

Another shortcoming of most prior art devices is the difficulty of attaching the tool to the device. A hedge trimmer will still largely be used without an extension device for most trimming operations and thus for the average weekend gardener, the extension pole will often be used for only one or two specific jobs which will most often be performed the same day that the trimmer is used without the extension pole. Thus, it is very important that the extension pole be easily connected and disconnected or otherwise will find very limited use.

SUMMARY OF THE INVENTION

It is thus an object of the present invention to provide an easily attached extension device to an electrically powered hand held tool such as a hedge trimmer which device does not create any substantial hazard that the electrical cord will become caught during use.

The present invention is for an extension device for use with electrically powered hand held tools such as hedge trimmers. The device has a hollow extension pole having a hand held end and a tool holding end and the extension pole has an electrical conductor or cord passing through the majority of the length thereof. A female plug is affixed to the tool held end of the extension pole and a male plug is affixed to the other end of the electrical conductor or cord and extends outwardly to accept an extension cord or other source of electrical power. A first hand grip means is attached to the hand held end of the extension pole and a second hand grip means is attached to an intermediate part of the extension pole. An electrical switch is connected near one of the first or second hand held grip means. Tool gripping means are affixed to the tool end of the pole and the tool gripping means has a strap which is moveable from a closed position wherein it is capable of holding the hand-gripping part of a tool. The strap can also be moved to an opened position in which the tool may be readily removed.

In a preferred embodiment, the tool gripping means has a recess having an annular groove which surrounds the female plug which is connected to the electrical conductor. Means for pivoting or extending the extension pole are also contemplated.

BRIEF DESCRIPTION OF THE DRAWINGS

FIG. 6 is a side view of a pivoting portion of an extension pole of the device of the present invention.

FIG. 7 is a top view of the portion of the pole shown in FIG. 6.

FIG. 8 is an enlarged cross-sectional view taken along line 8—8 of FIG. 7.

FIG. 9 is a side view, partly broken away, of an alternate embodiment of the tool holding end of the extension pole showing a hedge trimmer in phantom lines.

FIG. 10 is a cross-sectional view taken along line 10—10 of FIG. 9.

FIG. 11 is an end view analogous to FIG. 3 showing an alternate embodiment of gripping means of the tool of FIG. 1.

DESCRIPTION OF THE PREFERRED EMBODIMENTS

Figures 1, 2, 3, 4, 5:
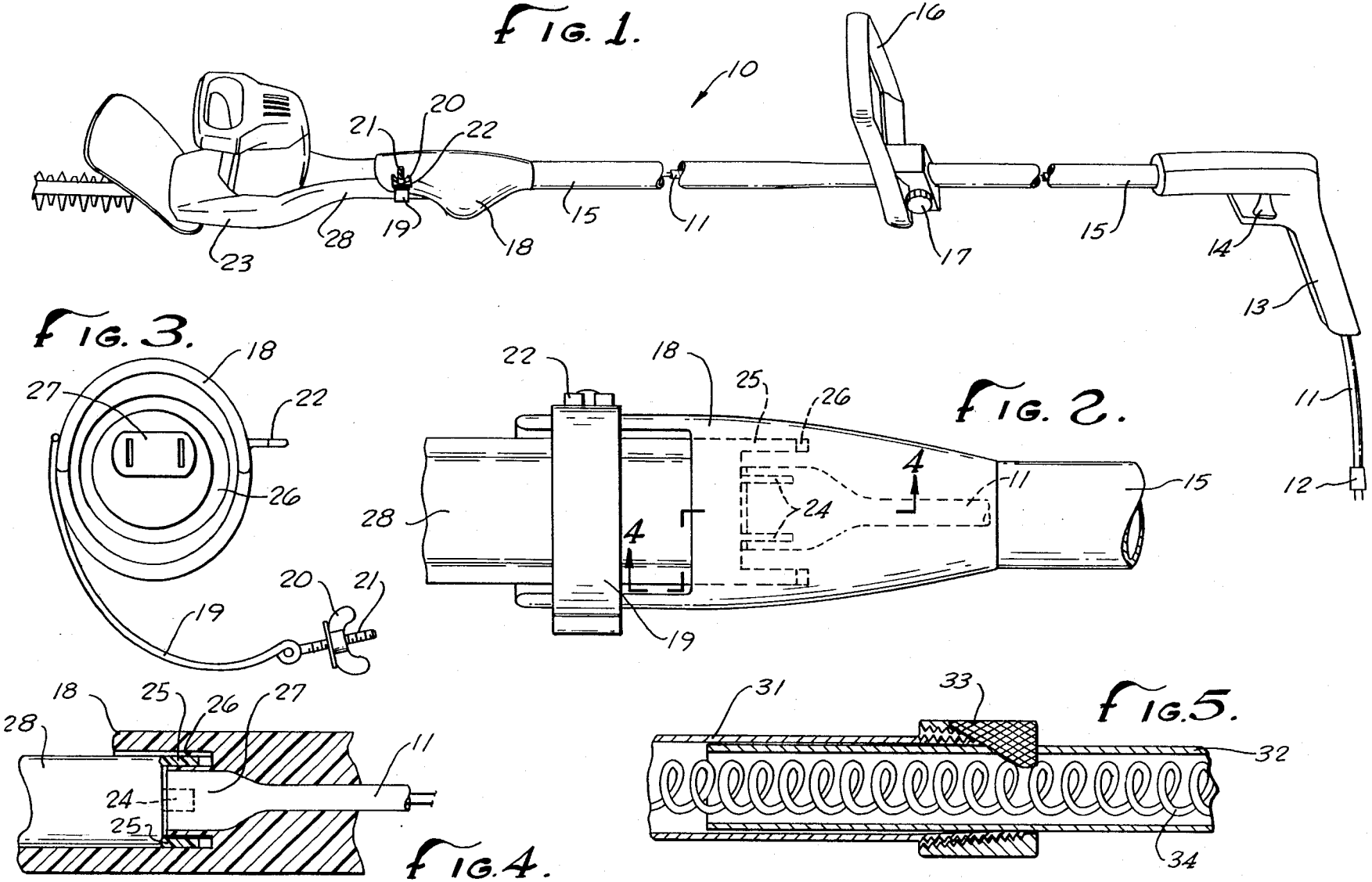
FIG. 1 is a perspective view partly broken away showing the extension device of the present invention having a hedge trimmer affixed thereto.
FIG. 2 is a fragmentary enlarged bottom view of the handle gripping portion of the tool of FIG. 1.
FIG. 3 is an enlarged end view of the tool end of the extension pole of FIG. 1.
FIG. 4 is a cross-sectional view taken along line 4—4 of FIG. 1.
FIG.5 is an enlarged cross-sectional view showing a portion of an extension pole having telescoping means therein.

The extension device of the present invention is shown in perspective view in FIG. 1 and indicated generally by reference character 10. The device has an electrical cord 11 which has a male plug 12 at its end. This is plugged into an extension cord to permit free movement of the extended device. The device has a handle 13 which is preferably molded from a polymer. In order to facilitate the use of the tool, a trigger 14 is connected to an electrical switch, not shown, which permits the easy turning on and off of the device. Conventional means may be provided for holding the switch in an opened position to further facilitate use of the device. A hollow pole 15 is molded or otherwise affixed to handle 13 and the electrical cord 11 passes through the center of pole 15. This feature causes the electrical cord to be free from the possibility of tangling in the branches to be cut and greatly facilitates the use of the device of the present invention. An intermediate handle 16 is slidingly attached to pole 15 and may be secured in a desired location by tightening knob 17. At the opposite end of the pole from the hand held or handle end is the tool handle gripping cup 18 which, like handle 13, is preferably molded from a polymer and securely held to the end of pole 15. A strap 19 has a wing nut 20 threaded onto a threaded stud 21 which cooperates with a lug 22 on cup 18. This provides a secure hold of the handle of hedge trimmer 23.

As shown best in FIGS. 2 and 4, hedge trimmer 23 has its male plug 24 held in a recess surrounded by a generally cylindrical ring 25. Ring 25 fits into a generally cylindrical recess 26 which surrounds female plug 28 which is molded into the tool handle gripping cup 18.

As can be readily seen from FIGS. 2 and 4, hedge trimmer 23 is securely held at two points. First, by the fitting of ring 25 into recess 26 and secondly by the surrounding of strap 19 of the handle 28 of trimmer 23. Strap 19 is preferably a flexible strap although it should not be very elastic. It should form a secure grip about the handle and is preferably made from a polymer or a polymer coated steel strap. The tightening of wing nut 20 against lug 22 provides a very secure attachment. An alternate means of attaching strap 19 about the tool handle is indicated in FIG. 11 where a patch of hook and eye fabric of the type commonly sold under the trademark "Velcro" is securely affixed both to the tool handle gripping cup 18 and to the strap 19. The patch of such material affixed to the cup is indicated by reference character 29 and affixed to the strap by reference character 30.

For many uses, it is desirable to provide a means for extending the length of pole 15. This extension should, however, continue to protect the electrical cord 11. One method for providing the combined telescoping and protecting feature is shown in FIG. 5 where pole 31 is telescoped over pole 32. Pole 31 is threaded at its terminous and a knurled nut 33 tightens pole 31 against pole 32. Inside of poles 31 and 32, the electrical conductor consists of a spiral cord 34 which permits the ready extension of the pole without damage to the cord.

The ability to pivot is also a useful feature for many trimming operations and one method for carrying out this pivoting action is shown in FIGS. 6, 7 and 8. In FIG. 6, pole 35 is pivoted with respect to pole 36 and held in several alternate positions by a series of grooves and ridges indicated by reference character 38. The cord 34 should be held close to the knob 37 so that entanglement in branches is unlikely.

FIG. 9 shows an alternate configuration of tool handle gripping cup 18 and the alternate configuration is indicated generally by reference character 40. The electrical connection of hedge trimmer 41 is made by plugging the male plug 42 of the cord 43 of trimmer 41 into a female plug which is molded into the tool handle gripping cup 40. Preferably, conductor 43 is wrapped over the top of pole 15 to essentially eliminate any loose cord. The strap 44 may be held to the tool handle by means similar to that described with reference to the device of FIG. 1. That is, a wing nut 45 is screwed onto a threaded stud 46 and against lug 47 which is molded into the side of cup 40. Strap 44 should provide the entire support for hedge trimmer 41 and thus should be relatively wide as shown in FIG. 9. As stated above, the strap which holds hedge trimmer 23 can be relatively narrow since the handle is also held by recess 26.

Further details of the tool handle gripping cup 40 are shown in FIG. 10 where pole 15 is shown in cross-sectional view.

While the device of the present invention has been discussed largely in conjunction with hedge trimmers, other types of tools may, of course, be used assuming that they are relatively light in weight and electrically operated. While the electrical switch is shown as being associated with the pistol type of handle 13, the switch may alternatively be placed elsewhere such as on intermediate handle 16. An important feature of the present invention is the surrounding of the electrical conductor within the extension pole. This surrounding may be complete as in the device shown in FIG. 1 or almost complete such as that shown in FIGS. 9 and 10.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An extension device for use with electrically powered hand held tools such as hedge trimmers, said device comprising:

a hollow extension pole having a held end and a tool end, said extension pole having an electrical conductor passing through the majority of the length thereof;

a female plug affixed to the end of the electrical conductor which is nearest the tool end of the extension pole;

a male plug affixed to the other end of the electrical conductor;

first hand grip means attached to the held end of the extension pole;

second hand grip means on the extension pole intermediate its ends;

electrical switch means connected near one of said first and second hand grip means; and tool gripping means affixed to the tool end of the extension pole, said tool gripping means having strap means moveable from a closed position where it is capable of holding a hand gripping part of a tool to an open position in which the tool may be removed and wherein said tool gripping means includes a recess having an annular groove which surrounds the female plug which is connected to the electrical conductor.

2. The extension device of claim 1 wherein said electrical conductor is entirely within said extension pole.

3. The extension device of claim 1 wherein said first hand grip means is a pistol grip handle including a trigger with said electrical switch in the trigger location.

4. The extension device of claim 1 wherein said second hand grip means is an adjustible grip which is slidingly affixable to the extension pole.

5. The extension device of claim 1 wherein said tool gripping means comprising a flexible polymeric strap having first and second ends, the first end being affixed to said tool gripping means and the second end having nut means affixed thereto.

6. The extension device of claim 1 wherein said tool gripping means comprising a flexible strap having first and second ends, the first end being attached to said tool gripping means and the second end having hook and eye attachment means affixed thereto.

7. The extension device of claim 1 further including telescoping means located between said second hand grip means and the tool end of the extension pole.

8. The extension device of claim 7 wherein said electrical conductor is a spiral cord conductor.

9. The extension device of claim 1 further including pivoting means located between said second hand grip means and the tool end of the extension pole.

10. The extension device of claim 9 wherein said electrical conductor is entirely within the extension pole except for a short length at the point of the location of the pivoting means.

11. An extension device for use with electrically powered tools such as hedge trimmers, said device comprising:

a hollow extension pole having a held end and a tool end, said extension pole having an electrical conductor passing through essentially the entire length thereof;

a female plug molded into the end of the electrical conductor which is nearest the tool end of the extension pole;

a male plug affixed to the other end of the electrical conductor said male plug extending past the held end of the extension pole;

first hand grip means attached to the held end of the extension pole;

second hand grip means on the extension pole intermediate its ends;

electrical switch means connected to one of said first and second hand grip means; and tool gripping means affixed to the tool end of the device, said tool gripping means having strap means moveable from a closed position wherein it is capable of holding a hand gripping part of a tool to an open position in which the tool may be removed and wherein said tool gripping means includes a recess having an annular groove which surrounds the female plug which is connected to the electrical conductor.

12. The extension device of claim 11 wherein said electrical switch means is connected to the first hand grip means.

13. An extension device for use with electrically powered tools such as hedge trimmers, said device comprising:

a hollow extension pole having a held end and a tool end, said extension pole having an electrical conductor passing through essentially the entire length thereof;

a female plug connected to the end of the electrical conductor which is nearest the tool end of the extension pole;

a male plug affixed to the other end of the electrical conductor;

first hand grip means attached to the held end of the extension pole;

second hand grip means attached to the extension pole intermediate its ends;

electrical switch means connected to one of said first and second hand grip means; and tool gripping means affixed to the tool end of the device, said tool gripping means having a strap which is moveable from a closed position where it is capable of holding a hand gripping part of the tool to an open position in which the tool may be removed, said tool gripping means having said female plug molded therein and wherein said tool gripping means includes a recess having an annular groove which surrounds the female plug connected to the electrical conductor.

* * * * *